United States Patent [19]

Embry

[11] Patent Number: 4,977,768

[45] Date of Patent: Dec. 18, 1990

[54] PICK-RESISTANT AXIAL SPLIT-PIN TUMBLER LOCK

[75] Inventor: Donald Embry, Cloverport, Ky.

[73] Assignee: 775 Corporation, Norcross, Ga.

[21] Appl. No.: 430,063

[22] Filed: Nov. 1, 1989

Related U.S. Application Data

[63] Continuation of Ser. No. 269,057, Nov. 9, 1988, abandoned.

[51] Int. Cl.[5] ..... E05B 27/08

[52] U.S. Cl. ..... 70/491; 70/378; 70/419

[58] Field of Search ..... 70/491, 378, 376, 392, 70/419

[56] References Cited

U.S. PATENT DOCUMENTS

| | | | |
|---|---|---|---|
| 1,619,252 | 3/1927 | George | 70/491 |
| 2,043,205 | 6/1936 | Thompson | 70/419 |
| 2,059,129 | 10/1970 | Maxwell | 70/378 |
| 3,878,700 | 4/1975 | Lopez | 70/491 |
| 4,193,277 | 3/1980 | Lo | 70/378 |
| 4,683,739 | 8/1987 | Hughes | 70/419 |
| 4,716,749 | 1/1988 | Johnson | 70/491 |

*Primary Examiner*—Robert L. Wolfe

*Attorney, Agent, or Firm*—Kimmel, Crowell & Weaver

[57] ABSTRACT

An axial split-pin tumbler lock having a rotatable operating element and a fixed element configured to define a shear plane therebetween, and wherein aligned bores extend in the two elements on opposite sides of the shear plane, with specially configured code pins and drive pins slidable in the bores in the elements across the shear plane, the specially configured code and drive pins being so constructed that they will bind or hang up in the respective bores in any number of axial positions during an attempt to pick the lock, thereby giving multiple and differing false readings of an unlocked condition of the lock and rendering it pick resistant.

12 Claims, 8 Drawing Sheets

PICK-RESISTANT AXIAL SPLIT-PIN TUMBLER LOCK

This application is a continuation, of application Ser. No. 269,057, filed Nov. 9, 1988.

FIELD OF THE INVENTION

This invention relates in general to locks, and more particularly, to pick-resistant axial split-pin tumbler locks.

DESCRIPTION OF THE PRIOR ART

Various locks and safety devices are known in the art for securing equipment, valuables and the like from unauthorized access. One such lock is an axial split-pin tumbler lock which includes a rotatable operating element and a fixed element. The rotatable and fixed elements are configured to define an annular shear plane at adjoining portions, with aligned bores therein extending axially on opposite sides of the shear plane between the two elements. Pins or tumblers are slidable in the bores across the shear plane, and include a code pin in an outer portion of the bore in one of the elements and an aligned but separate drive pin in an inner portion of the bore in the other element. The code pins and drive pins are in axial, abutting end-to-end engagement with one another and springs in the bottom of the bores engage the drive pins and urge the drive pins and code pins outwardly in the bores to a position where the point or line of contact between the code pins and drive pins is out of alignment with the shear plane, thereby preventing rotation of the rotatable element relative to the fixed element and locking the lock.

The code pins are accessible with a specially shaped key for depressing the code pins in the bore, which, in turn, depresses the drive pins against the bias of the springs and enables the junction between the code pins and drive pins to be aligned with the shear plane so that the rotatable element can be rotated relative to the fixed element for unlocking the lock. In a typical lock, the code pins are of different lengths and the key has specially positioned bittings or shoulders for engaging and depressing the respective code pins a predetermined distance to unlock the lock.

Examples of axial pin tumbler locks are disclosed in U.S. Pat. Nos. 3,756,049, 3,878,700, 3,903,720, 4,041,739, 4,078,405, 4,227,387, 4,328,691 and 4,507,945.

Prior art axial pin tumbler locks can be unlocked without a key by a skilled operator using a lock pick. To accomplish this, a tool or pick having a plurality of probes corresponding to the number of pins is inserted into the lock and rotational torque is applied to the rotatable element of the lock while the pick is manipulated to cause the probes to sequentially push the pins rearwardly in their bores until the operator determines that return spring force is no longer being applied to that pin. This indicates that the subject pin has become lodged against a shoulder of one of the elements at the shear plane, thereby placing that pin in an unlocked position. When all of the pins have been thus positioned, the lock can be opened.

Numerous efforts have been made in the prior art to prevent such picking of the locks, as exemplified in some of the prior art patents listed above. However, it is believed that all such prior art locks can be picked by a skilled operator. In fact, the simplest of such locks can be opened with a pick in as little as ten seconds. More sophisticated locks may require the operator to exercise greater effort to position the junction between the code pins and drive pins at the shear plane, but trial and error usually results in successfully opening a lock after a very short time.

Because of the above-described difficulties with prior art locks, substantial losses are being experienced by vending machine operators and others requiring security and/or authorized access to various equipment, spaces, and the like. Some high security locks are available to alleviate these problems in particularly sensitive environments, but their cost prohibits their use in most applications.

SUMMARY OF THE INVENTION

Accordingly, it is a principal object of the present invention to provide a simple and inexpensive lock which is pick-resistant.

Another object of the invention is to provide a lock having specially configured tumblers reciprocable in bores extending through fixed and rotating parts of the lock, so that manipulation of the tumblers during an attempt to pick the lock will give multiple and differing false readings of an unlocked condition of the lock.

A further object of the invention is to provide an axial split-pin tumbler lock in which the pins are configured so that they will give multiple and differing false readings during an attempt to pick the lock.

Yet another object of the invention is to provide an axial split-pin tumbler lock having code pins engaged with drive pins, and return springs engaged with the drive pins to normally urge the pins to a locked position, wherein the springs are of such length that they will not bottom out when the pins are fully depressed during an attempt to pick the lock.

A more specific object of the invention is to provide an axial split-pin tumbler lock having a rotatable operating element and a fixed element configured to define a shear plane therebetween, and wherein aligned bores extend in the two elements on opposite sides of the shear plane, with specially configured code pins and drive pins slidable in the bores in the elements across the shear plane, the specially configured code and drive pins being so constructed that they will bind or hang up in the respective bores in any number of axial positions during an attempt to pick the lock, thereby giving multiple and differing false readings of an unlocked condition of the lock and rendering it pick resistant.

In carrying out the foregoing and other objects, the code pins and drive pins have elongate tapered bodies with a cylindrical head on the narrow end of the body. The code pin bodies and heads are of varying length and some of them are turned end-for-end with respect to others. The diameters of the heads and the larger ends of the bodies are such that they have a close fit in the bores in the fixed and rotating elements of the lock. Accordingly, when a torsional force is applied to the rotating element during an attempt to pick the lock, those code pins and/or drive pins having a portion thereof spanning the shear plane will tilt in the respective bores, causing the cylindrical head to bind in the bore, and/or will engage with their head against the shoulder formed by misalignment of the bores, thereby preventing opening of the lock and giving multiple and differing false readings of an unlocked condition of the pins. This construction is such that a different reading can be obtained from each pin each time an attempt is made to pick the lock, rendering it virtually impossible to pick the lock.

BRIEF DESCRIPTION OF THE DRAWINGS

The foregoing and other objects and advantages of the invention will become apparent from the following detailed description and accompanying drawings, in which like reference characters designate like parts throughout the several views, and wherein.

DETAILED DESCRIPTION OF THE PREFERRED EMBODIMENTS

Figure 1:
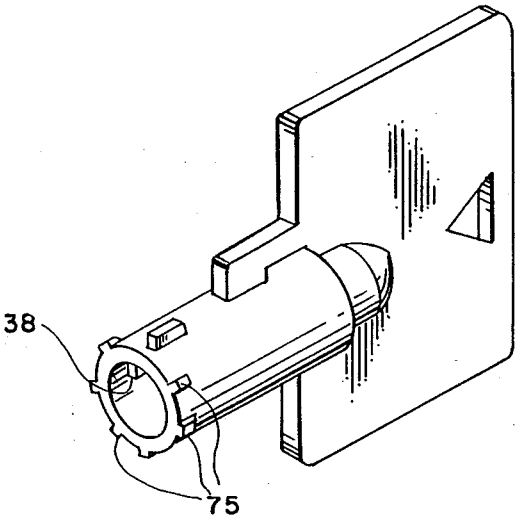
FIG. 1 is an exploded perspective view showing one form of lock according to the invention and the associated key.

Referring more specifically to the drawings, a first form of lock according to the invention is indicated generally at 10. The lock comprises a front case 11 having a radially enlarged head or flange 12 thereon and an externally threaded body 13 with flattened side portions 14 and 15. In use, the body is adapted to be inserted through an opening "0" in the wall "W" of an apparatus to be secured, with the head 12 engaged against the outside of the wall and a retaining nut 16 engaged on the body behind the wall (see FIG. 7, for example). The body has a stepped bore 17 formed therethrough, including an outer, small diameter portion 18 and an intermediate diameter portion 19 defining an annular, rearwardly facing shoulder 20 therebetween in the headed portion of the case. A large diameter, inner bore 21 extends axially rearwardly from the intermediate diameter portion, defining a shoulder 22 therewith, and extends through the open rear end 23 of the case.

A rotatable element 30 is rotatably disposed in the bore 17, and comprises a key guide 31, outer cylinder 32 and rearwardly extending operating shaft 33. In the specific example shown, the key guide and outer cylinder are separately formed and are secured together by a fluted tail piece 34 on the key guide frictionally engaged in a bore 35 in the outer cylinder and pinned thereto with a pin or key 36 extended radially through the parts. The key guide 31 has an axially extending slot 37 therein for cooperation with a lug or ramp 38 on the key so that when the key is inserted into the annular space 39 between the key guide and the case, the rotatable element can be rotated upon rotation of the key.

A plurality of axially extending bores 40 are formed through the outer cylinder 32, in substantial alignment with the annular space between the key guide and case, as seen best in FIGS. 7–13. In a typical axial tumbler, split-pin lock there are seven such bores, equally spaced around the axis of the cylinder.

An inner cylinder or fixed element 45 is secured in the annular space between the operating shaft and the rear portion of the case by a pin or key 46 extended through the side of the case and into engagement with the inner cylinder, and extends from contiguous relationship at its forward end with the outer cylinder to a position spaced slightly forwardly of the open rear end of the case. The forward end of the inner cylinder and the rearward surface of the outer cylinder define a shear plane 47 on opposite sides of which relative movement of the rotatable and fixed elements occurs. A plurality of bores 48 are formed through the inner cylinder, in alignment with the bores 40 formed through the outer cylinder.

Figure 4:
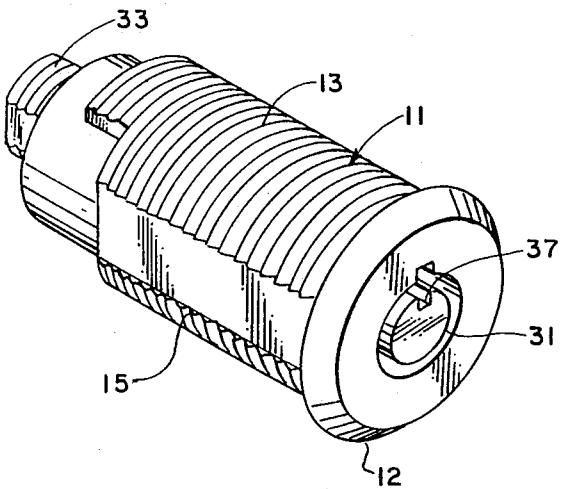
FIG. 4 is a side elevational view representing the dimensional relationships of a first set of code pins as used in the invention.
Figure 4:
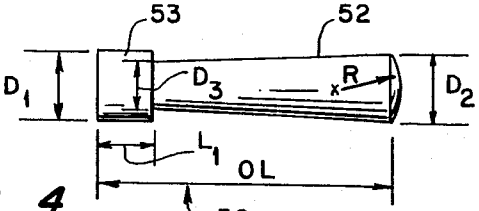
Figure 5:
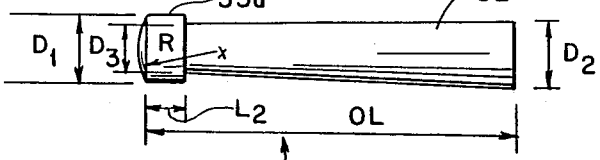
FIG. 5 is a view similar to FIG. 4, showing the dimensional relationships of a second set of code pins as used in the invention.

Two sets of slightly differently configured code pins 50 and 51 are slidable in the bores 40, and each comprises a tapered body 52 having cylindrical heads 53 and 53*a* thereon, respectively. As seen in FIG. 4, one set of code pins 50 have a shorter overall length (OL) than the overall length of the code pins 51, and also have a relatively longer cylindrical head 53, as indicated by length $L_1$, as compared with length $L_2$ for the head 53*a* of pins 51. Three of the code pins may have the dimensional relationships as shown for pin 50, while four of the code pins may have the dimensional relationships shown for pin 51. In one preferred construction of the lock of the invention, the code pins 50 and 51 all have a different overall length, with the three code pins 50 having lengths of 0.203, 0.218 and 0.235 inches, while the four code pins 51 have overall lengths of 0.250, 0.265, 0.281 and 0.296 inches. The cylindrical heads 53 on pins 50 are from 0.060 to 0.065 inches long, while the heads 53*a* on pins 51 are from 0.028 to 0.033 inches long. The diameters $D_1$ and $D_2$ for the cylindrical head and the larger end of the tapered body are equal, being from 0.078 to 0.079 inches in a preferred construction, and the diameter $D_3$ of the smaller end of the tapered body is 0.050 to 0.055 inches. Further, in the preferred construction the bores 40 and 48 through the outer and inner cylinders, respectively, have diameters of from 0.0805 to 0.0815 inches, thus providing clearance for the pins in the bores.

Figure 6:
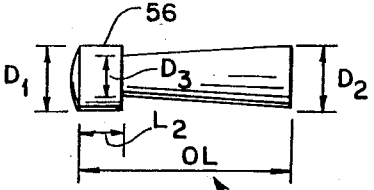
FIG. 6 is a view similar to FIG. 4, showing the dimensional relationships of the drive pins used in the lock of the invention.
Figure 2:
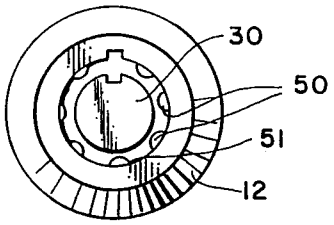
FIG. 2 is an end view in elevation of the lock of FIG. 1.
Figure 3:
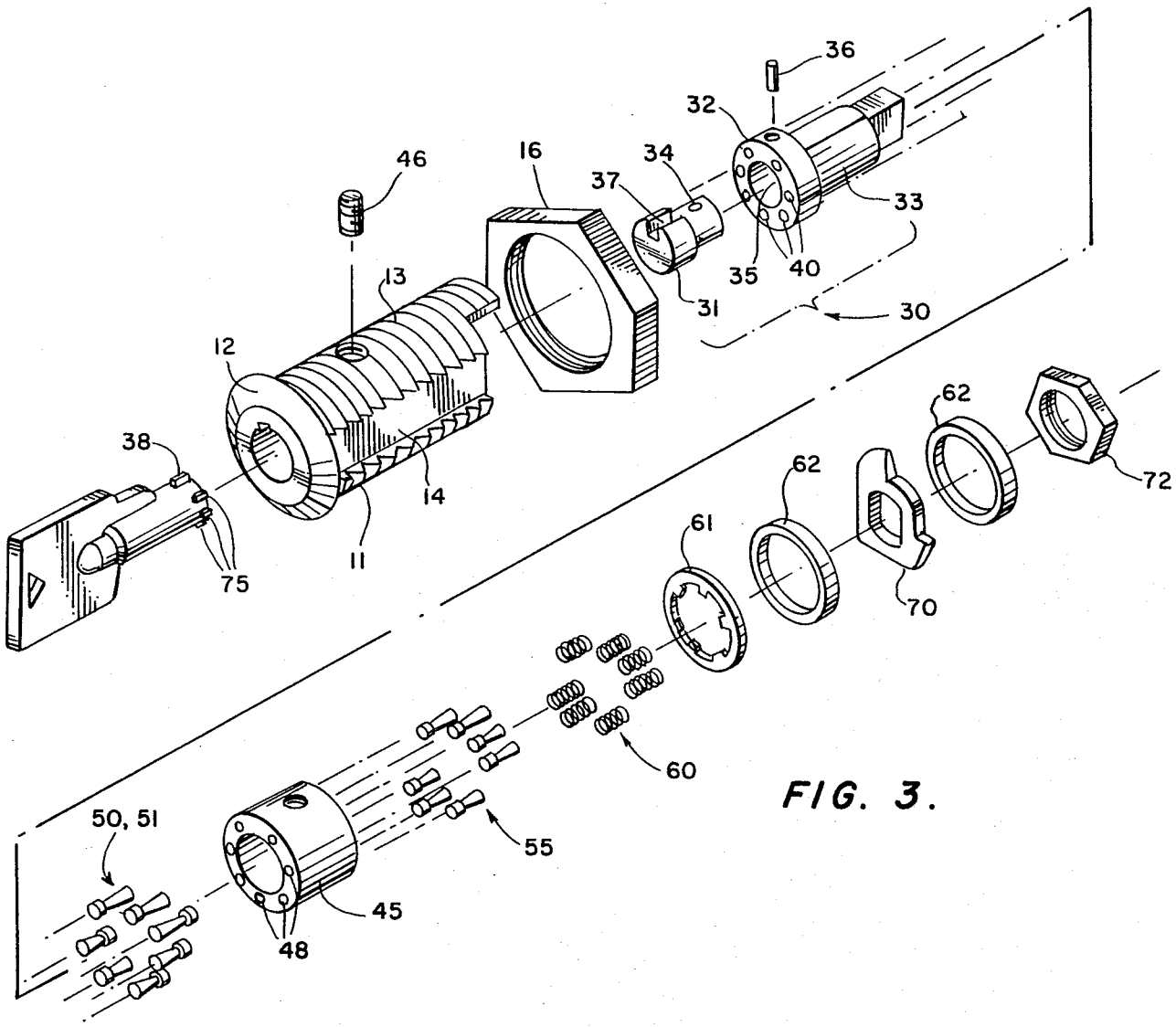
FIG. 3 is an exploded perspective view of the lock of FIG. 1.

The drive pins 55, as shown in FIG. 6, are all identically configured, having an overall length of about 0.160 inch, with the cylindrical head 56 having a length of from 0.028 to 0.033 inches, and having the same diameters $D_1$, $D_2$ and $D_3$ as the code pins, i.e., 0.078 to 0.079, 0.078 'to 0.079 and 0.050 to 0.055, respectively.

It should be further noted that the cylindrical heads on the drive pins and on code pins 51 are all slightly rounded or radiused, while the butt ends or larger ends of the tapered body of code pins 50 are similarly slightly radiused. When installed, the radiused ends of the code pins engage the radiused ends of the drive pins and provide some leeway for enabling the pins to slide past the adjacent fixed or movable element at the shear plane when the lock is in its unlocked condition (see FIG. 8).

Figure 7:
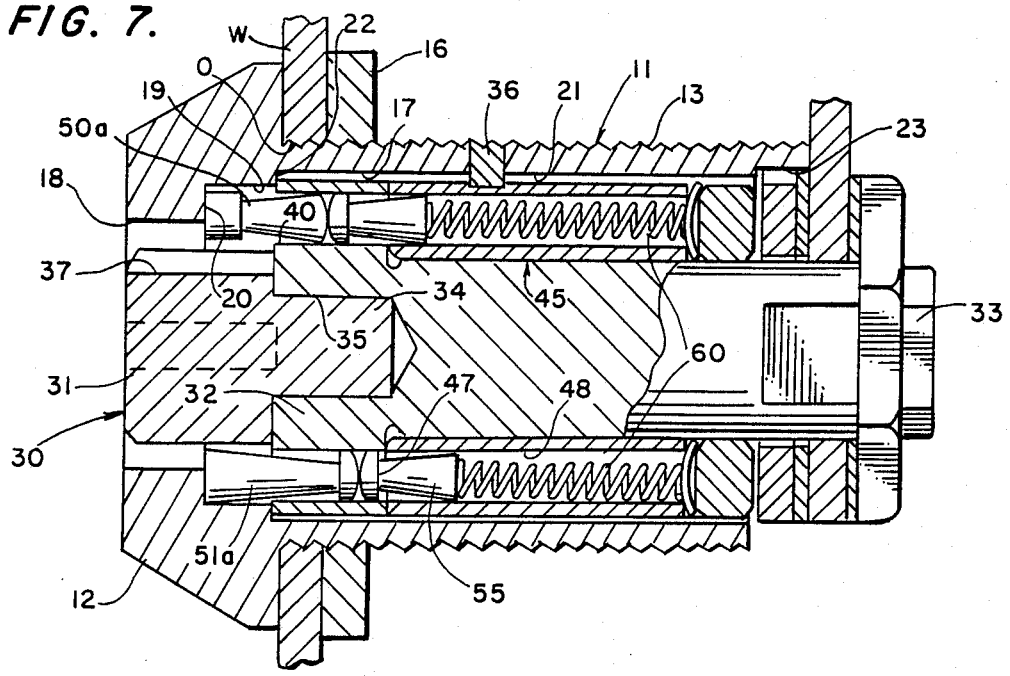
FIG. 7 is an enlarged longitudinal vertical sectional view of the lock of FIG. 1, showing the pins in their at-rest locked position, biased forwardly in the bores.
Figure 9:
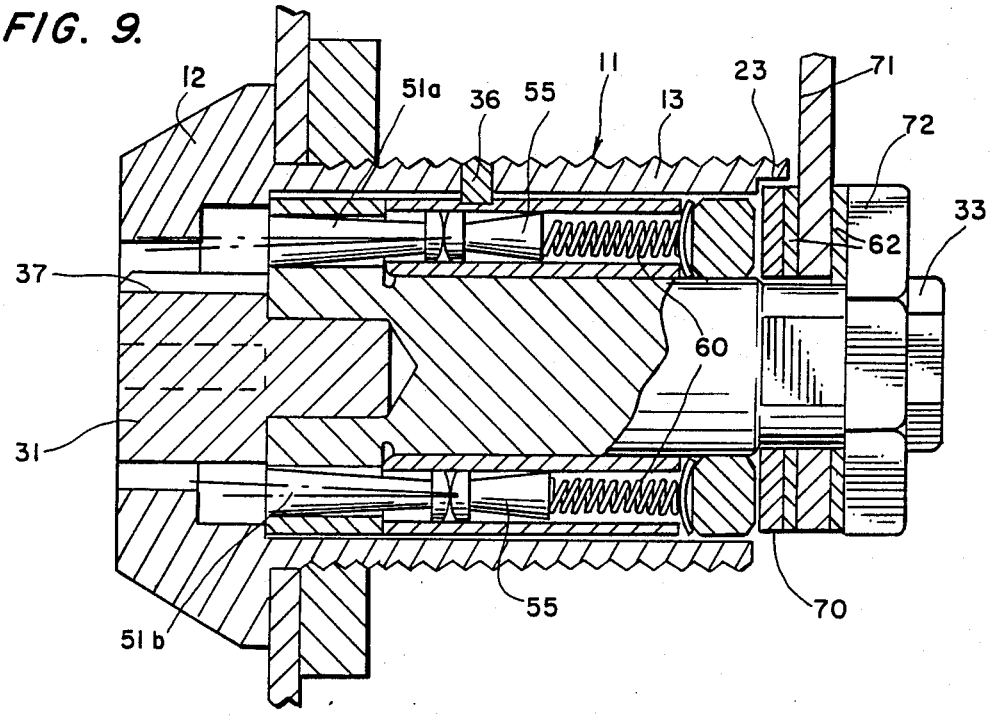
FIG. 9 is an enlarged sectional view similar to FIG. 7, showing the pins fully depressed in the lock and illustrating how the springs are of such length that they do not bottom out with the pins fully depressed.

Coil springs 60 in the bores 48 are engaged with the drive pins 55 to urge the drive pins and thus the code pins forwardly to a locked, at-rest position as shown in FIG. 7. In this position, the forward movement of the pins is limited by engagement of the code pins with the shoulder 20 in the case. The springs are retained in the bores by spring washer 61 and spacer 62 engaged over the operating shaft 32 in the open end of the case and retained on the shaft by a stop disc 70, bolt or cam lock 71 and retaining nut 72, all as conventional in the art. The springs 60 are provided in two lengths to accommodate the longer code pins without bottoming out in their respective bores when the code pins are fully depressed as shown in FIG. 9 and the bottom half of FIG. 11, for example.

In normal use, the key is inserted into the lock and rotated to open the lock. This is accomplished by the bittings or lugs 75 on the key, which are designed to engage respective code pins and depress them just sufficiently to place the area or point of contact between the code pins and drive pins at the shear plane, whereby the rotatable element may be rotated relative to the fixed element.

When an attempt is made to pick a lock, or open it without a key, a specially designed pick is inserted into the lock and probes are contacted with the code pins. A torsional force is applied to the rotatable element of the lock, while the probes are pushed inwardly against the code pins and manipulated until the code pins do not move or feel as though they are hung up at the shear plane (no return spring force felt). When all code pins have been thus positioned the lock may be opened. The setting of the probes on the pick indicate a particular key cut, so that a key can be made for that lock if desired. In conventional locks, only a relatively short amount of time is required for an experienced operator to position the pins for opening a lock.

In the specific lock described herein, the length $L_1$ of the head on code pins 50 is designed to give an indication for a number 4 key cut, while the length $L_2$ of the head on code pins 51 is designed to give an indication for a number 2 key cut. In operation, the heads 53 of code pins 50 will typically bind or hang up in the outer cylinder bores 40 (above the shear plane), while the heads 53*a* of code pins 51 will hang up or bind in the bores 48 in the inner cylinder (below the shear plane). In other words, as rotational force is imparted to the movable element, both the code and drive pins, depending upon which one spans the shear plane in a particular bore, will be tilted, causing the head of that pin to bind in the respective bore, preventing opening of the lock and giving a false reading on a pick probe engaged with the pin.

As can be seen in FIGS. 7–14, the pins can hang up or bind in the respective bores in any position, depending upon the axial and rotational forces imparted to them. The shape of the tapered bodies enables either the code or drive pins to tilt and bind at any position in either the inner or outer bores, and regardless of the direction of rotation of the movable element of the lock. Further, the lip or shoulder defined by the tapered body and head enables the pins to hang up at the shoulders created by misalignment of the movable and fixed elements upon rotation thereof.

For instance, FIG. 7 shows a pair of code pins 50*a* and 51*a* at the top and bottom, respectively, of the figure. As can be seen, the code pins are of different length and are from the two sets or groups of slightly differently configured code pins described above. These code pins are in their at-rest, locked position and the head of code pin 50*a* is forwardly disposed, while the head of code pin 51*a* is rearwardly disposed.

Figure 8:
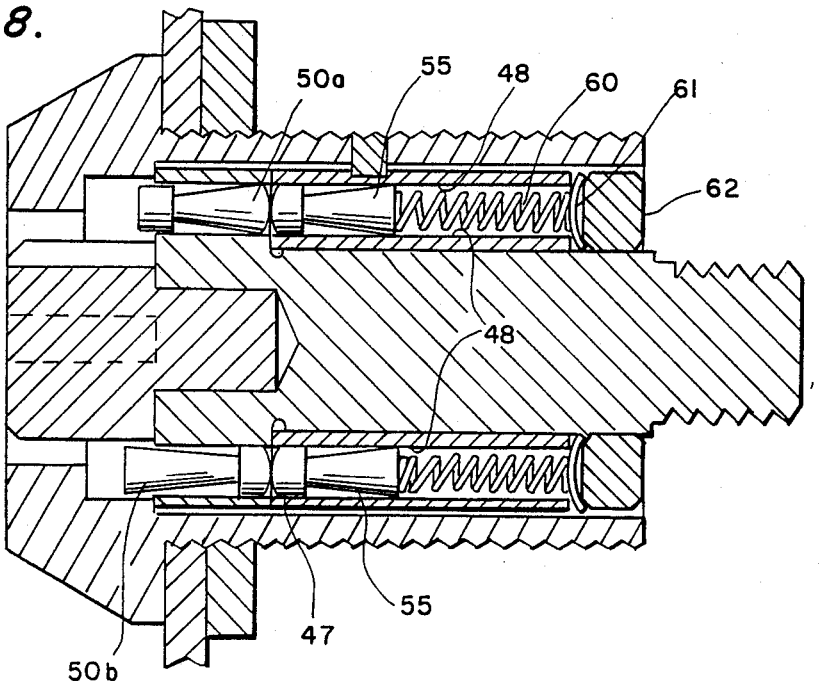
FIG. 8 is an enlarged sectional view similar to FIG. 7, showing the pins in their unlocked position, with the points of contact between the code pins and driver pins disposed at the shear plane between the movable elements of the lock.

FIG. 8 shows a pair of code pins 50*a* and 50*b*, selected from the same set or group of code pins, albeit of different lengths, as described earlier, and disposed in opposite end-for-end orientations. The code pins shown in this figure are properly positioned with the area of separation between the pins being disposed in alignment with the shear plane whereby the lock may be opened.

FIG. 9 shows a pair of code pins 51*a* and 51*b*, selected from the same group or set of code pins as described earlier, but of slightly different lengths and both arranged in the same end-for-end orientation. These code pins are shown in their fully depressed position and, as can be observed, the springs are not bottomed out. The code pins in this figure span the shear plane and thereby prevent opening of the lock.

Figure 10:
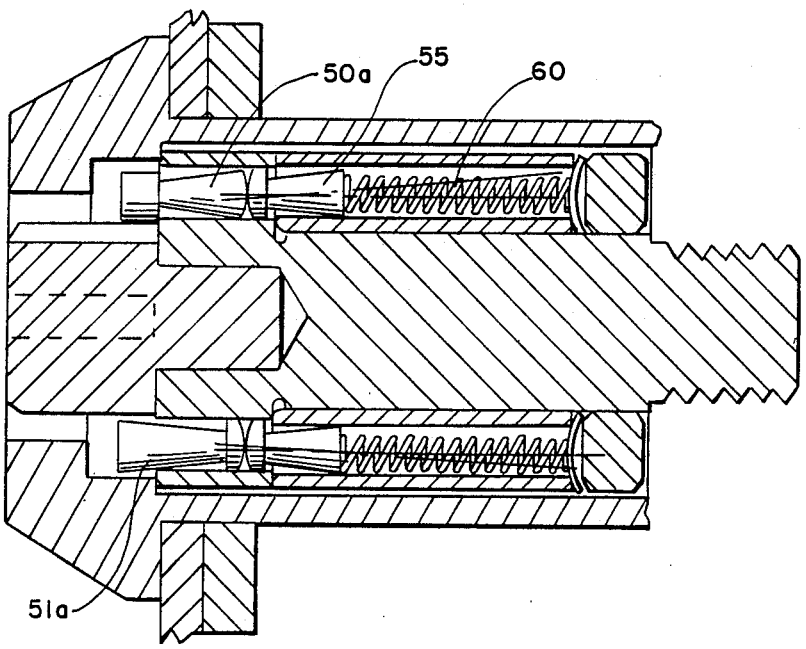
FIG. 10 is an enlarged sectional view similar to FIG. 7, showing the pins partially depressed, as during an attempt to pick the lock, with the shoulder at the head of one of the code pins engaged against the end of the outer cylinder or rotatable element, and the head of one of the drive pins tilted and hung up in its bore, whereby both of said pins are in positions to prevent unlocking of the lock.

FIG. 10 shows a pair of code pins 50*a* and 51*a*′, with the head of code pin 50*a* engaged against the shoulder defined by the misaligned inner and outer cylinders, as might occur, for example, during an attempt to pick the lock. In this figure, the drive pins 55 are in spanning relation to the shear plane, preventing opening of the lock. It should be noted that the drive pin 55 at the bottom half of this figure is tilted in the bores, causing the head to bind in the bore in the outer cylinder.

Figure 11:
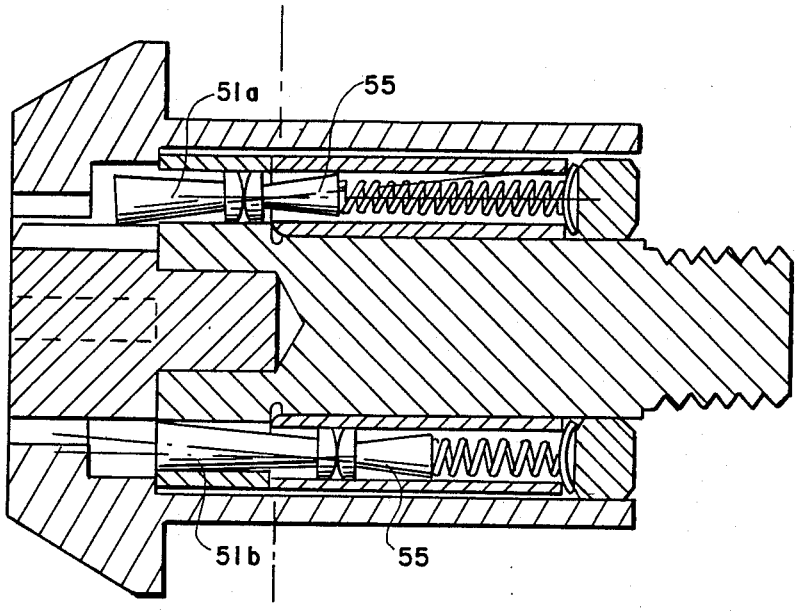
FIG. 11 is an enlarged sectional view similar to FIG. 7, showing one set of pins fully depressed in their respective bores, and showing another set wherein both the code pin and drive pin are tilted to cause their heads in the bore.

FIG. 11 shows a pair of code pins 51*a* and 51*b*, both oriented with their heads disposed inwardly. The code pin 51*a* shown in the top half of this figure is shown tilted in the bores, causing its head to bind in the bore of the outer cylinder, resulting in the drive pin being disposed in spanning relation to the shear plane. The code pin 51*b* in the bottom half of this figure is fully depressed, causing it to span the shear plane. Either (and both) of these pin orientations will prevent opening of the lock.

Figure 12:
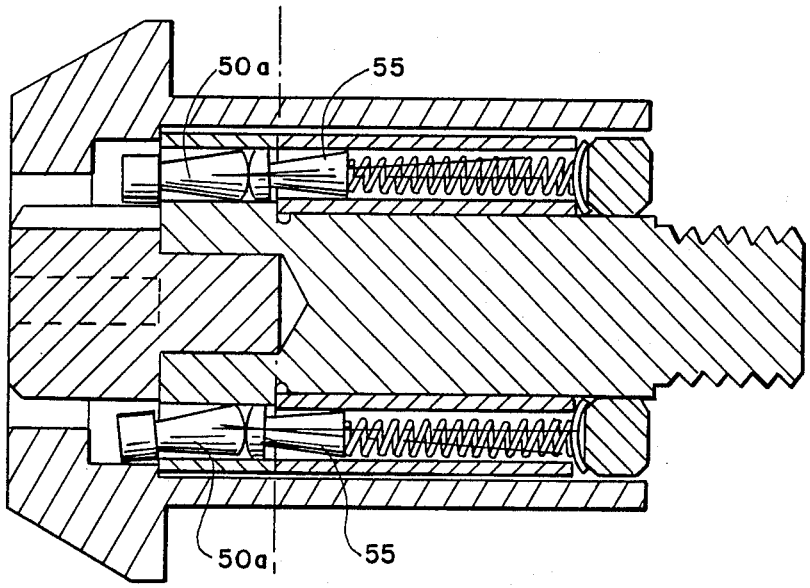
FIG. 12 is enlarged sectional view similar to FIG. 7, showing two sets of pins with the shoulders formed by their heads engaged against the end of the outer cylinder or rotatable element, preventing unlocking of the lock.

FIG. 12 shows a pair of code pins 50*a* and 50*a* of substantially identical configuration, but of slightly different lengths, both disposed with their head outwardly disposed and engaged or hung up against the shoulder defined by the outer surface of the outer cylinder. In other words, the ability of the pins to tilt, coupled with the lip defined by the head and the reduced or narrow portion of the body, enables the head of these pins to hang up on the shoulder, or bind in the bore as previously described.

Figure 13:
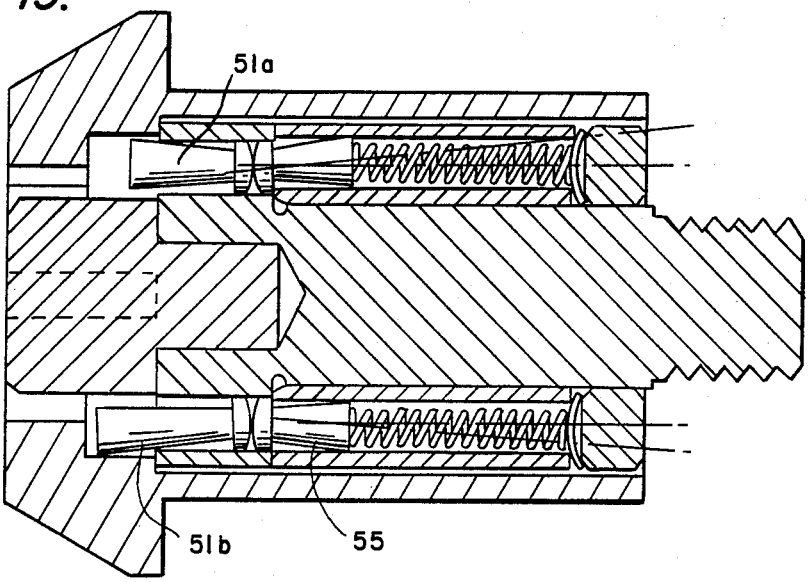
FIG. 13 is a view similar to FIG. 12, showing a further two sets of pins with the heads of the drive pins in each set engaged against the end of the inner or fixed element, preventing unlocking of the lock.

FIG. 13 shows a pair of code pins 51*a* and 51*b* similar to those shown in FIG. 11, but somewhat shorter in overall length. In this figure, the code pins are shown tilted in their bores, and the heads of the drive pins 55 are shown hung up or engaged against the shoulder defined by the inner cylinder.

Figure 14:
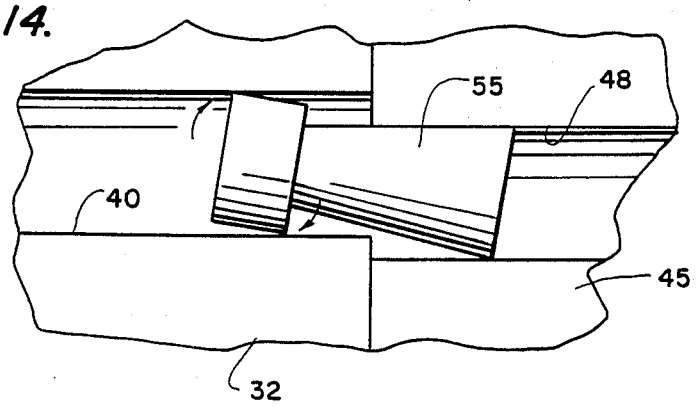
FIG. 14 is a greatly enlarged, fragmentary view partially in section, showing in exaggeration the manner in which the pins are tilted to bind their heads in the bores.
Figure 15:
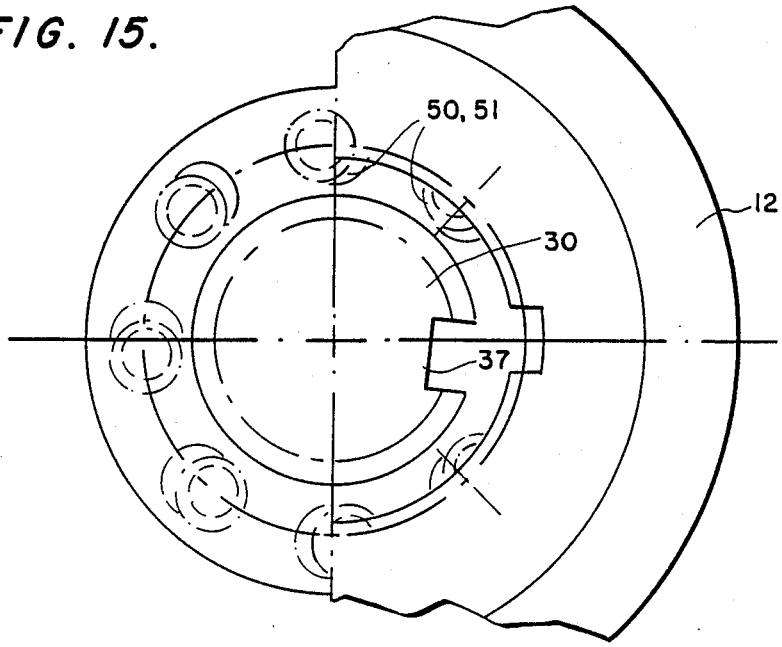
FIG. 15 is a greatly enlarged fragmentary end view showing schematically how the fixed and rotatable elements are rotationally displaced relative to one another to tilting of the pins.
Figure 16:
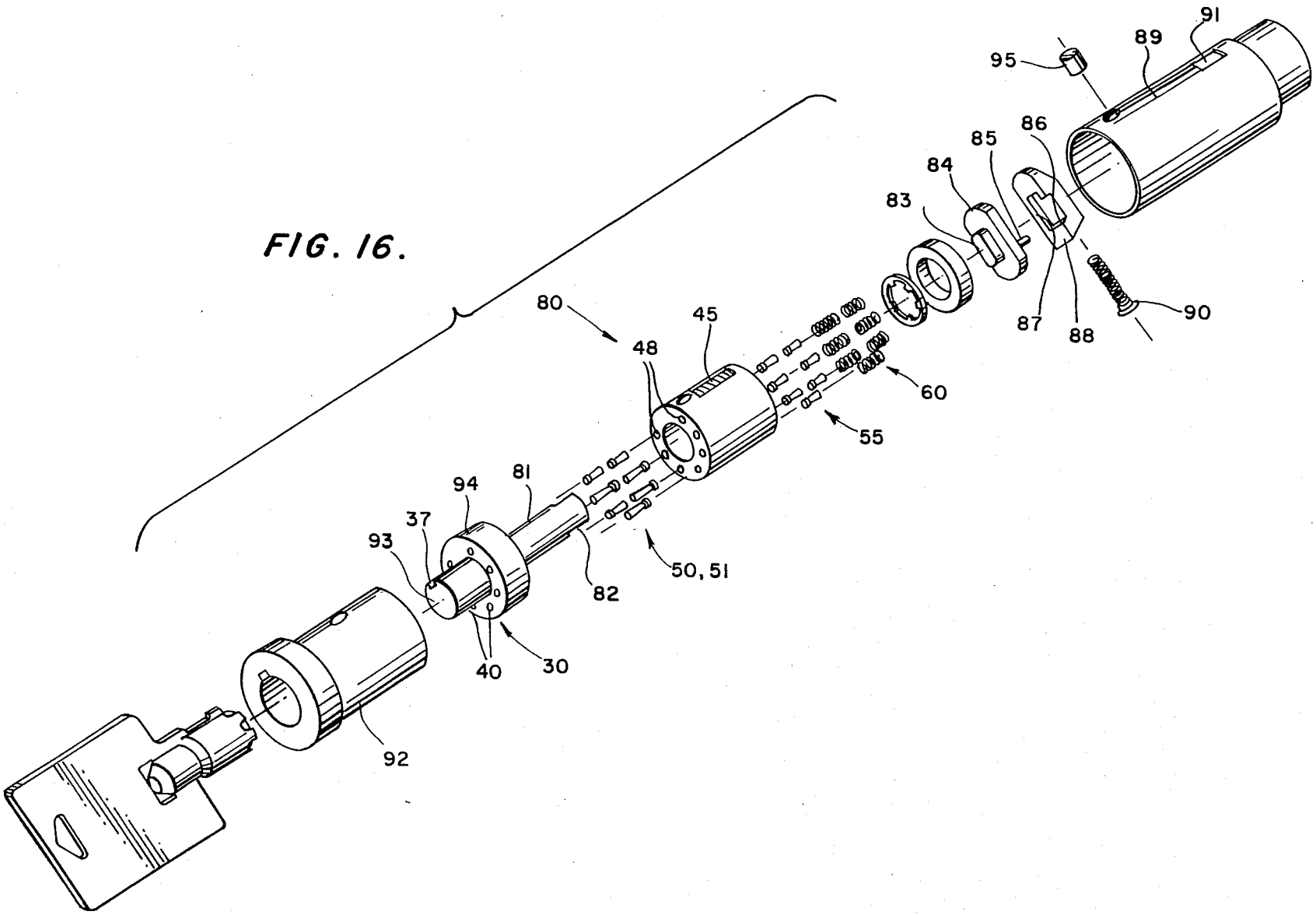
FIG. 16 is an exploded perspective view of a second form of lock a to the invention.
Figure 18:
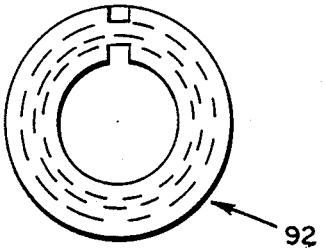
FIG. 18 is an end view of the case of FIG. 17.
Figure 17:
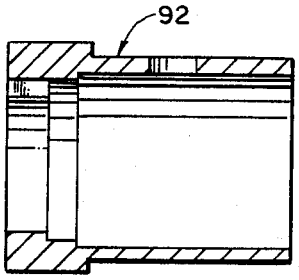
FIG. 17 is an enlarged, longitudinal vertical sectional view of the forward or outer case of the lock of FIG. 16.
Figure 19:
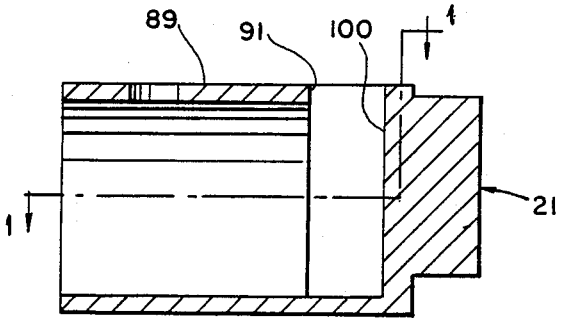
FIG. 19 is an enlarged, longitudinal vertical sectional view of the rearward or inner case of the lock of FIG. 16.
Figure 20:
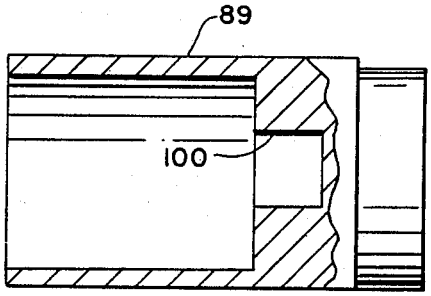
FIG. 20 is a view in section taken along line 20—20 in FIG. 19.
Figure 21:
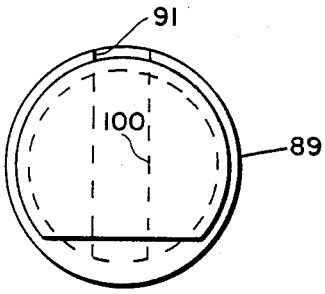
FIG. 21 is an end view of the case of FIGS. 19 and 20.
Figure 23:
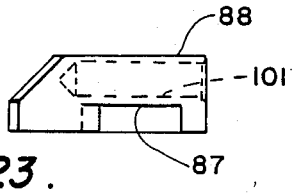
FIG. 23 is a side view of the bolt of FIG. 21.
Figure 24:
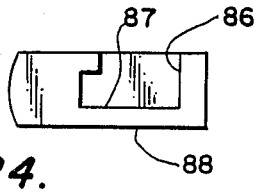
FIG. 24 is a bottom view of the bolt of FIG. 22.
Figure 22:
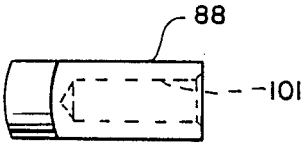
FIG. 22 is a top view of the bolt used in the lock of FIG. 16.
Figure 25:
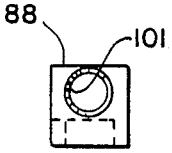
FIG. 25 is an end view of the bolt of FIG. 22.

The manner in which the pins are tilted to cause their heads to bind in the respective bore portions is shown best in FIG. 14, which depicts in exaggerated form the manner in which the inner and outer cylinders are rotationally displaced to cause the pins to tilt and bind the head in the bore.

A modified version of the lock is indicated generally at 80 in FIGS. 16–25. This form of the invention functions the same as that previously described with respect to the structure and function of the code pins 50, 51 and drive pins 55. However, instead of the cam lock 71, the operating shaft 81 has a bifurcated end 82 which cooperates with a web 83 on a cam member 84 to oscillate or rotate the cam member and cause a pin 85 to engage the edge 86 of cut-out 87 in bolt member 88 and pull the bolt member into the rear case 89 to unlock the lock. Spring 90 engages the bolt to urge it outwardly through opening 91 in the case 89 and into locked position. Additionally, the forward or outer case 92 is configured slightly differently for mounting in different structures, and the key guide 93, outer cylinder 94 and operating shaft 81 are formed as one piece. The lock assembly is held in assembled relationship by a pin or screw 95 which extends through the wall of the rear case and the wall of the forward case and into the inner cylinder or fixed element 45.

As seen best in figures 19–24, the rear case has a channel 100 formed in an inner rear portion thereof for sliding reception of the bolt 88. The bolt 88, in turn, has a bore or pocket 101 formed therein for receiving the spring 90.

The bolt lock structure operated by the lock mechanism of the invention, and as briefly described immediately above, is of essentially conventional construction and will not be further described.

The components of the lock are made of conventional materials, including hardened brass for the code and drive pins and inner and outer cylinders.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

I claim:

1. A pick-resistant axial split-pin tumbler lock, comprising:

a rotatable operating element and a fixed element in contiguous, end-to-end relationship thereto, said operating element and fixed element being configured to define a shear plane therebetween and having aligned bores therein extending on opposite sides of the shear plane;

aligned code pins and drive pins slidable across the shear plane in the bores in the elements, said code pins and drive pins being in end-to-end abutting engagement with one another and normally positioned so that the points of contact between the pins are out of alignment with the shear plane, but being adapted to be moved to positions where the points of contact between the code pins and drive pins are aligned with the shear plane to permit the operating element to be moved with respect to the fixed element to open the lock; and said code pins and drive pins each having an elongate body tapering inwardly from one end thereof to an enlarged head on the other end, and dimensioned so that they are enabled to tilt in the bores when they extend or project across the shear plane and the operating element is rotated with respect to the fixed element, whereby the pins will bind or hang up in the respective bores in any number of axial positions during an attempt to pick the lock, giving multiple and differing false readings of an unlocked condition of the lock and rendering it pick resistant.

2. In a pick-resistant axial split-pin tumbler lock in which a rotating operating element is configured and disposed in contiguous relationship to a fixed element so that an annular shear plane is defined at confronting faces between them, and in which aligned bores extend through the elements across the shear plane, with positionable split pin tumblers slidable in the bores and normally projecting across the shear plane to prevent rotation of the operating elements relative to the fixed element, thereby locking the lock, but being movable to positions with the points of contact or lines of separation between the split pins disposed in alignment with the shear plane so that the operating element may be rotated relative to the fixed element to unlock the lock, the improvement comprising:

each of said pins having an elongate body tapering inwardly from one end thereof to an enlarged head on the other end, and said pins being dimensioned so that they are enabled to tilt and bind in said bores in any axial position of the pin in the bore when the operating element is rotated relative to the fixed element and the pin spans said shear plane, preventing further rotation of said operating element and unlocking of said lock and giving numerous and variable false code readings of the positions of the pins during attempts to pick the lock.

3. A lock as claimed in claim 2, wherein:

said pins have elongate bodies tapering from a wide or thick end to a narrow end, and a cylindrical head on the narrow end of said bodies, said head and wide end of said body having the same diameter and being only slightly smaller than the diameter of the bores, enabling limited tilting movement of the pins in the bores when they span the shear plane between the operating and fixed elements and the elements are rotated slightly relative to one another to misalign the bores therein, but resulting in binding of the cylindrical head therein when so tilted, and said cylindrical head also defines a shoulder which can hang up against the face of the fixed element.

4. A lock as claimed in claim 3, wherein:

said split-pin tumblers include code pins and drive pins, said code pins normally being disposed in the bores in said operating element and said drive pins normally being disposed in said bores in said fixed element, both said code pins and said drive pins having said tapered bodies, enabling them to tilt and bind in the respective bores.

5. A lock as claimed in claim 4, wherein:

some of said code pins are differently configured and/or sized relative to other of said code pins so as to require different amounts of axial movement of the respective code pins in said bores before the points of separation between the code pins and drive pins become aligned with the shear plane to permit unlocking ad opening of said lock.

6. A lock as claimed in claim 5, wherein:

all of said drive pins are identically shaped and sized; and said code pins include two different configurations in which the cylindrical heads have two different lengths, all of said code pins having a different overall length from one another.

7. A lock as claimed in claim 6, wherein:

some of said code pins are oriented with their head ends disposed inwardly relative to the lock, and other of said code pins are oriented with their head ends disposed outwardly relative to the lock.

8. A lock as claimed in claim 1, wherein:

some of said code pins are oriented with their head ends disposed inwardly relative to the lock, and other of said code pins are oriented with their head ends disposed outwardly relative to the lock.

9. A lock as claimed in claim 8, wherein:

the heads on the code pins oriented with their headed ends disposed outwardly relative to the lock all have the same length, with the tapered bodies thereof having different lengths and spanning the shear plane so that they will tilt in the respective bores when an effort is made to pick the lock, causing the headed end to engage against and hang up at the shear plane, whereby all of said outwardly oriented code pins will produce the same key-cut indication on the pick.

10. A lock as claimed in claim 9, wherein:

there are seven sets of code pins and drive pins slidable in respective bores in the lock, numbered one through seven, and the number one, two and three code pins all have their headed ends oriented outwardly relative to the lock, while the remaining code pins have their headed ends oriented inwardly relative to the lock and are of different lengths so as to produce different key-cut indications when an effort is made to pick the lock.

11. A lock as claimed in claim 10, wherein:

the drive pins are all identically configured and sized and have their headed ends oriented outwardly relative to the lock.

12. A pick-resistant axial split-pin tumbler lock, comprising:

a rotatable operating element and a fixed element in contiguous, end-to-end relationship thereto, said operating element and fixed element being configured to define a shear plane therebetween and having aligned bores therein extending on opposite sides of the shear plane;

aligned code pins and drive pins slidable across the shear plane in the bores in the elements, said code pins and drive pins being in end-to-end abutting engagement with one another and normally positioned so that the points of contact between the pins are out of alignment with the shear plane, but being adapted to be moved to positions where the points of contact between the code pins and drive pins are aligned with the shear plane to permit the operating element to be moved with respect to the fixed element to open the lock;

said code pins each having an elongate body tapering inwardly from one end thereof to an enlarged head on the other end and being dimensioned so that they can tilt and bind in the respective bores when the code pins are engaged by a lock pick in an effort to pick the lock and the operating element is rotated relative to the fixed element, said code pins having different lengths so that different amounts of axial movement in the bores are required for each of the code pins to enable the lock to be operated; and some of said code pins being oriented with their head ends disposed inwardly relative to the lock, and other of said code pins being oriented with their head ends disposed outwardly relative to the lock.

* * * * *